US006705604B2

(12) United States Patent
Lorenzi

(10) Patent No.: US 6,705,604 B2
(45) Date of Patent: Mar. 16, 2004

(54) PRE-FOLDING MACHINE FOR COVERS AND WRAPPERS

(75) Inventor: Mario Lorenzi, Villafranca-Padova (IT)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/292,284

(22) Filed: Nov. 12, 2002

(65) Prior Publication Data

US 2003/0075852 A1 Apr. 24, 2003

Related U.S. Application Data

(63) Continuation of application No. PCT/IT01/00223, filed on May 9, 2001.

(30) Foreign Application Priority Data

May 12, 2000 (IT) ..... PD2000A0124

(51) Int. Cl.[7] ..... B41L 43/04

(52) U.S. Cl. ..... 270/32; 270/58.07; 493/399; 493/396; 412/1; 412/9; 412/22

(58) Field of Search ..... 270/58.07, 32; 493/399, 396; 412/1, 9, 22

(56) References Cited

U.S. PATENT DOCUMENTS

| | | | |
|---|---|---|---|
| 2,126,138 | A | 8/1938 | Riese |
| 3,866,568 | A | 2/1975 | Minami |
| 4,408,780 | A | 10/1983 | Detterman et al. |
| 5,088,973 | A | 2/1992 | Bruce et al. |
| 5,176,371 | A | 1/1993 | Rau et al. |
| 5,702,220 | A | 12/1997 | Combs |

*Primary Examiner*—Patrick Mackey
(74) *Attorney, Agent, or Firm*—Laurence A. Greenberg; Werner H. Stemer; Ralph E. Locher

(57) ABSTRACT

The novel pre-folding machine for book covers and/or wrappers, has two symmetrical units each provided with two parallel axes on which marking disks and counteracting cylinders are installed. One of the two symmetrical units is fixed, while the other is positioned on guides or rails that extend in parallel to the shafts on which the disks and cylinders are supported and it can be translated by way of a screw, in order to adapt the distance between the marking disks to the book thickness. The machine is also provided with two pairs of flap folding pliers, each one with two wings. One of the wings is fixed and coplanar with the sheet and serves as counteracting element for the other wing that rotates by approximately 180° folding the cover flap around the marking carried that was carried out just upstream by the disks of the two symmetrical units.

8 Claims, 1 Drawing Sheet

PRE-FOLDING MACHINE FOR COVERS AND WRAPPERS

CROSS-REFERENCE TO RELATED APPLICATION

This application is a continuation of copending International Application No. PCT/IT01/00223, filed May 9, 2001, which designated the United States and which was published in English on Nov. 15, 2001.

BACKGROUND OF THE INVENTION

Field of the Invention

The invention lies in the field of bookbinding machines and machines for the gathering of books and volumes. More specifically, the invention concerns a machine for the marking and folding of covers and wrappers (also called dust jackets).

The covers and wrappers of books are printed on flat sheets that successively are marked and folded along lines that are spaced from each other of a distance substantially coinciding with the thickness of the book (spine of the book), with the cover front and back sides folded near the spine, in such a way as to make it possible to read the book keeping the sheets gathered together on the spine.

It is also possible to make other folds that correspond to the flaps of the wrapper around the cover edges.

To mark the covers and/or wrappers pre-folding machines are used, which are mainly provided with two parallel axes on which rotary marking disks and counteracting cylinders are installed. To each marking disk on one axis corresponds a counteracting cylinder on the other axis.

The central disks are spaced from each other of a distance corresponding to the thickness of the sheets to be bound or of the book to be covered, while the two intermediate disks are positioned only a few millimeters away from the inner disks, in such a way as to obtain a small band of cover that is glued to the first and last page of the book, and the two outer disks are spaced from the inner edges of a distance corresponding to the width of the book pages.

Besides the disks that mark the cover to allow it to be folded, also folding pliers and pressure rollers are provided to fold the flaps of the covers and/or wrappers completely.

Since the thickness and the width of books are variable, the position of the disks and cylinders must be varied consequently.

It is important to consider that the width of the cover edge glued to the first and last page of the book is not of primary importance for the binding and reading of the book and therefore it is often kept constant even for different books.

In the pre-folding machines used at present the adjustment of the distance between the various disks and consequently between the various rollers, as well as between the pliers and pressure rollers, is made by hand, by loosening the fastening screws of disks, rollers, pliers and pressure rollers and by shifting disks, rollers, pliers and pressure rollers by hand and then tightening the relevant fastening screws.

This adjustment operation requires suitable manual skills and considerable precision, and since it is easy to make mistakes or to be imprecise, it takes some time to carry it out properly. In fact, the position of the disks must be extremely precise and furthermore the disks must be perfectly symmetrical with respect to the center of the spine of the cover or wrapper.

SUMMARY OF THE INVENTION

It is accordingly an object of the invention to provide a pre-folding machine for covers and wrappers, which overcomes the above-mentioned disadvantages of the heretofore-known devices and methods of this general type and which provides for a machine and system that eliminate all the above drawbacks with a new type of pre-folding machine for covers and/or wrappers wherein single and symmetrical adjustment of the various disks and rollers has been studied and implemented.

With the foregoing and other objects in view there is provided, in accordance with the invention, a pre-folding machine for book covers or wrappers, comprising:

first and second symmetrical units each having two mutually parallel shafts and one or more marking disks and one or more counteracting cylinders installed on the shafts;

a guide device extending parallel to the parallel shafts;

the first symmetrical unit being fixed and the second symmetrical unit being displaceably mounted on the guide device for displacement along the parallel shafts and for adapting a distance between the marking disks to a book thickness of the book cover or wrapper to be folded.

In accordance with an added feature of the invention, the second symmetrical unit is translated with a screw along the guide device for adjusting the distance between the marking disks.

In accordance with an additional feature of the invention, at least two pairs of flap folding pliers disposed downstream of the marking disks in a product processing direction, each of the flap folding pliers having a first wing fixed and coplanar with a surface of a cover to be folded and a second wing rotating by substantially 180° for folding the cover flap about a marking made by the disks of the two symmetrical units, with the first wing serving as a counteracting element for the second wing.

In accordance with a further feature of the invention, the marking disks include inner marking disks formed with two raised marking lines. Preferably, the spacing distance between the two raised marking lines is constant.

In accordance with again an added feature of the invention, the marking disks include inner marking disks each comprising two marking disks positioned side by side.

In accordance with again an additional feature of the invention, the spacing distance between the two marking disks is constant.

In accordance with a concomitant feature of the invention, the guide device comprises at least two mutually parallel rails.

The new pre-folding machine comprises, in its main parts, two symmetrical units, each one of which is provided with marking disks and counteracting cylinders for one half of the cover, with a cover feed system and with pliers and pressure rollers for the folding of the wrapper flaps.

Each symmetrical unit as described above comprises a structure that supports two axes parallel to each other.

Each axis is provided with at least three marking disks and three counteracting cylinders.

A first marking disk is positioned at the end of one axis and the corresponding counteracting cylinder is positioned on the other parallel axis.

This first disk-cylinder assembly carries out the marking that serves to make one of the two folds of the cover spine.

In other words, a second marking disk and the relevant counteracting cylinder are installed at a short distance from the first disk-cylinder assembly, in a more central position with respect to the axes. This second disk-cylinder assembly carries out the marking that serves to fold the cover near the spine.

The third marking disk and the relevant counteracting cylinder are positioned along the axes, spaced from the first disk-cylinder assembly of a distance that substantially corresponds to the width of the book page.

The first and second disk-cylinder assemblies are fixed to the two axes, while the third disk-cylinder assembly is applied to the two axes with any system that allows it to be placed in the desired position along the axes.

The two symmetrical units are aligned, so that the two pairs of axes are perfectly aligned and that the first two disk-cylinder assemblies of each symmetrical unit face the other symmetrical unit.

Both symmetrical units are installed on guides or rails that are parallel to the two pairs of axes of the two units: one of the two units is fastened to the guides together with the first disk-cylinder assembly and aligned with the group of sheets to be bound; the second unit slides on the guides in such a way as to approach or move away from the second unit while keeping the axes aligned.

A large spindle screw that engages parts of the structure of the second symmetrical unit and is provided with a handwheel or handle makes it possible to move the second symmetrical unit towards or away from the fixed symmetrical unit. In the alternative, a stepper motor (or an equivalent motorized system) may be provided for moving the non-stationary unit relative to the stationary unit, i.e., the adjust the operational spacing distance between the two units.

The cover feed system comprises two opposing conveyor belts that receive the marked covers and convey them to the pliers for the folding of the flaps.

The conveyor belts are generally in a central position with respect to the two symmetrical units and are coupled so that each cover is held between them thanks to the pressure exerted and moved by the conveyor belts themselves.

The folding pliers are positioned at the sides of the conveyor belts.

Each pair of folding pliers comprises two wings that are symmetrical to each other, hinged to a longer side that is parallel to the direction of movement of the covers and provided with rotation lever systems.

In practice, one of the wings of the pliers is coplanar with the cover and serves as a support for the side of the cover corresponding to the book front, while the other wing is rotated in such a way as to fold the cover flap.

The pliers are installed on guides that are perpendicular to their wings and parallel to the guides and axes of the symmetrical units, so that it is possible to adapt the position of the pliers to the width of the covers or wrappers.

Two metal sheets, positioned above the fixed wings of the pliers, keep the wrappers in the correct position during the folding operations.

Beyond the wings of the pliers that make the flaps of the covers and/or wrappers there are counter-rotating rollers that are perpendicular to the direction of advance of the covers and have the function to move the covers forward and mark and reinforce the fold of the flaps.

Other features which are considered as characteristic for the invention are set forth in the appended claims.

Although the invention is illustrated and described herein as embodied in a pre-folding machine for covers and wrappers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
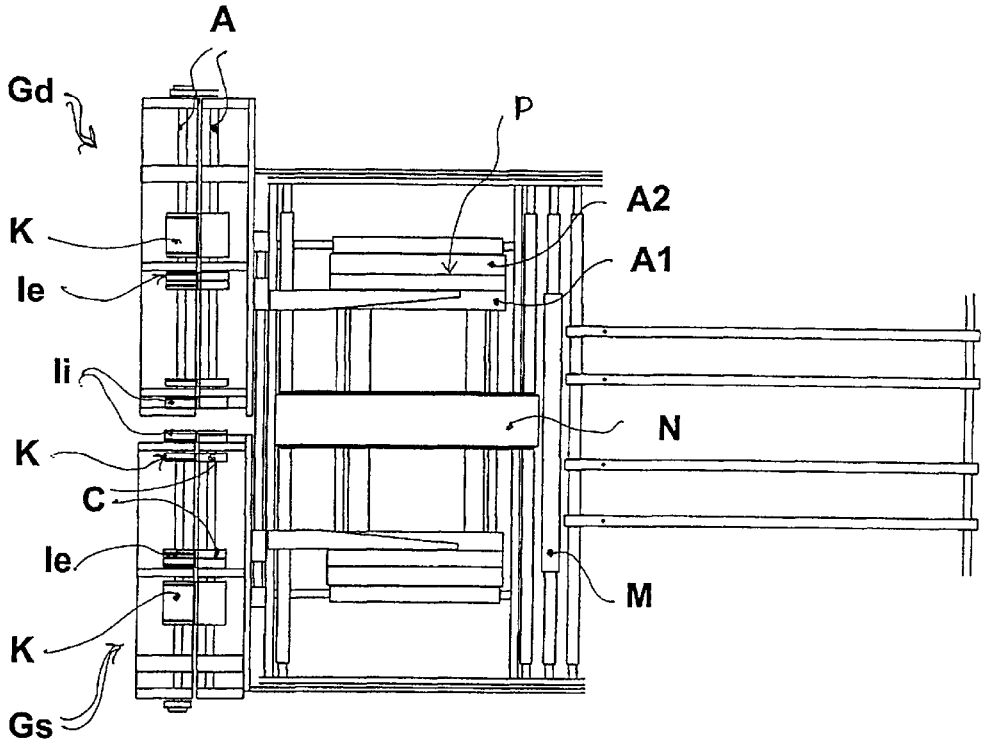
FIG. 1 shows a plan view onto a pre-folding machine according to the invention.
Figure 2:
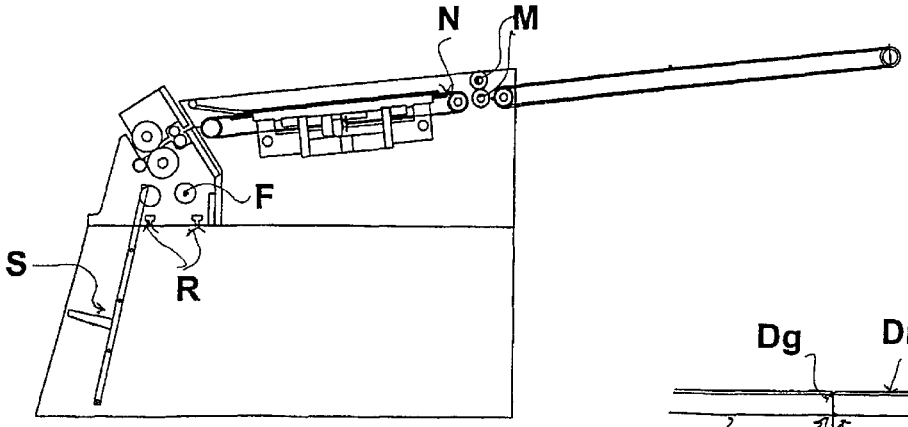
FIG. 2 is a vertical section taken through the novel device.

Referring now to the figures of the drawing in detail and first, particularly, to FIG. 1 thereof, there are shown two symmetrical units Gs, Gd, each one provided with two mutually parallel axes A and provided with marking disks Ii and Ie and corresponding counteracting cylinders C.

Other cylinders K facilitate the shifting of the cover or wrapper to be pre-folded.

Figure 3:
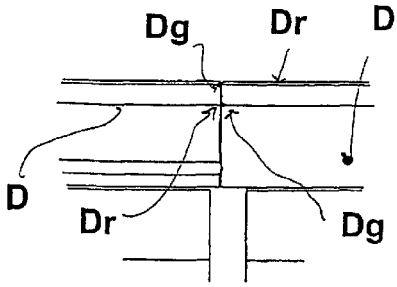
FIG. 3 is a schematic partial plan view onto a cylinder unit of the device.

In this example the two inner disks Ii and the cylinder unit C that is nearest to the axis of the cover comprise two complementary cylinders D, each one provided with a groove Dg and with a raised line Dr that marks the two central folds corresponding to the book spine and to the cover opening (FIG. 3).

One of the two units Gd is fixed with respect to the machine frame, while the other unit Gs slides in suitable rails R parallel to the axes A. The unit Gs can be translated by means of a worm screw F, in such a way as to adjust the folding width of the book cover spine.

The covers to be folded are placed into a special feed unit S from which they are collected and sent to the pre-folding section through the disks Ii and Ie and the cylinders C of the two units Gd, Gs.

After the pre-folding phase the cover is conveyed to the folding pliers P by way of two coupled conveyor belts N.

Each one of the two pairs of pliers P comprises two wings A1, A2, one of which is fixed and coplanar with the cover and serves as counteracting element for the other wing A2 that rotates to fold the cover flap around the marking made by the disks I of the two symmetrical units Gd, Gs.

Finally the cover is sent through two counter-rotating rollers M that are perpendicular to the direction of advance of the covers and have the function to move the covers forward and mark and reinforce the folding of the flaps.

The above are the basic outlines of the invention, on the basis of which those of skill in the pertinent art will be enabled to implement the invention. Any change which may be necessary upon implementation is to be regarded as completely protected by the present invention, provided that it is based on the same innovative concept described herein.

I claim:

1. A pre-folding machine for book covers or wrappers, comprising:

first and second symmetrical units, each of said first and second symmetrical units having two mutually parallel shafts and at least one marking disk and a counteracting cylinder installed on said shafts;

a guide device extending parallel to said parallel shafts of said first and second symmetrical units;

said first symmetrical unit together with its two mutually parallel shafts being fixed and said second symmetrical unit together with its two mutually parallel shafts being displaceably mounted on said guide device for displacement in a direction along said parallel shafts and for adapting a distance between said marking disks to a book thickness of the book cover or wrapper to be folded.

2. The pre-folding machine according to claim 1, which comprises a screw for translating said second symmetrical unit along said guide device and for adjusting the distance between said marking disks.

3. The pre-folding machine according to claim 1, which comprises at least two pairs of flap folding pliers disposed downstream of said marking disks in a product processing direction, each of said flap folding pliers having a first wing fixed and coplanar with a surface of a cover to be folded and a second wing rotating by substantially 180° for folding the cover flap about a marking made by said disks of said two symmetrical units, with the first wing serving as a counter-acting element for said second wing.

4. The pre-folding machine according to claim 1, wherein said marking disks include inner marking disks formed with two raised marking lines.

5. The pre-folding machine according to claim 4, wherein a spacing distance between said two raised marking lines is constant.

6. The pre-folding machine according to claim 1, wherein said marking disks include inner marking disks each comprising two marking disks positioned side by side.

7. The pre-folding machine according to claim 6, wherein a spacing distance between said two marking disks is constant.

8. The pre-folding machine according to claim 1, wherein said guide device comprises at least two mutually parallel rails.

* * * * *